United States Patent [19]

Rentfrow et al.

[11] Patent Number: 4,471,698

[45] Date of Patent: Sep. 18, 1984

[54] MASS-SPRING RAINHEAD

[75] Inventors: Richard W. Rentfrow; Edwin M. Stryker, both of Hennepin County, Minn.

[73] Assignee: Honeywell Inc., Minneapolis, Minn.

[21] Appl. No.: 352,489

[22] Filed: Feb. 25, 1982

[51] Int. Cl.[3] ..... F42C 1/00

[52] U.S. Cl. ..... 102/234; 102/275

[58] Field of Search ..... 102/272, 273, 274, 275, 102/237, 239, 242, 243, 253, 265, 222, 221, 223

[56] References Cited

U.S. PATENT DOCUMENTS

| | | | |
|---|---|---|---|
| 1,861,521 | 6/1932 | Brandt | 102/239 X |
| 2,619,905 | 12/1952 | Apothéloz | 102/272 X |
| 2,871,788 | 2/1959 | Guerne | 102/239 |
| 3,854,402 | 12/1974 | Kosonocky | 102/275 |
| 3,952,663 | 4/1976 | Forst et al. | 102/275 |

*Primary Examiner*—David H. Brown

*Attorney, Agent, or Firm*—George W. Field

[57] ABSTRACT

Apparatus for rendering the fusing of a ballistic missile, including a firing pin, insensitive to raindrop impact, by interposing between the firing pin and the site of impact of raindrops, a resonant mechanical system having a natural period which is long compared to the duration of impact of any raindrop.

2 Claims, 1 Drawing Figure

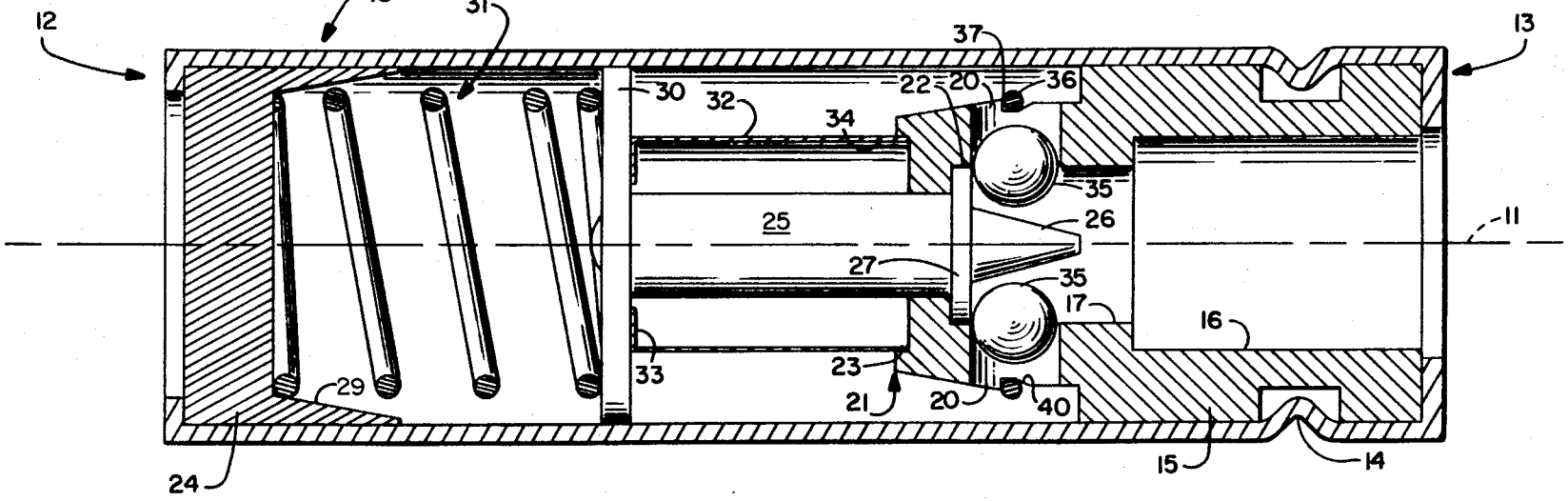
13
11
14
16
15
35
26
35
17
36
40
37
20
22
20
21
23
27
34
25
32
30
33
31
10
29
24
12

MASS-SPRING RAINHEAD

The Government has rights in this invention pursuant to Contract No. DAAK10-80-C-0286 awarded by the Department of the Army.

TECHNICAL FIELD

This invention relates to the field of munitions, and particularly to the fusing of ballistic missiles to cause them to fire upon impact with a target.

BACKGROUND OF THE INVENTION

Ballistic missiles are intended to be discharged from field pieces of various bores, and to carry destructive loads of explosives to be fired upon impact with their targets. Under various conditions various targets may be encountered, and the missile must fire reliably when it impacts steel, water, sand, plywood or mud.

Difficulty is sometimes encountered when missiles must be fired during rain storms: rain drops have been observed as large as six millimeters in diameter, and such a raindrop possesses a very considerable impact force. It has also been observed, however, that the duration of impact of even the largest raindrop is very short, and that the frequency of raindrop impact is very low.

BRIEF SUMMARY OF THE INVENTION

The present invention comprises a rainhead which renders the fusing of ballistic missiles relatively insensitive to raindrop impact by interposing ahead of the firing pin a mechanical system including a spring and an impact disc having a mass such that the natural period of the system is long compared to the impact duration time and frequency of raindrops. Lockout means are also provided to prevent movement of the firing pin at the time the missile is discharged from the piece.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and the accompanying descriptive matter, in which there is illustrated and described a preferred embodiment of the invention.

BRIEF DESCRIPTION OF THE DRAWING

The single FIGURE of the drawing comprises a longitudinal axial section of a rainhead according to the invention.

DESCRIPTION OF THE PREFERRED EMBODIMENT

A rainhead according to the invention comprises a tube 10 extending along an axis 11 between an apertured first or target end 12 and apertured second or detonator end 13.

Secured within end 13 of tube 10, as by crimping 14, is a detonator housing 15 having a chamber 16 accessible through the aperture in end 13. Chamber 16 is axially continuous with a second chamber 17 of reduced diameter having a plurality of bores 20 radial to axis, and the inner end 21 of chamber 17 has an internal shoulder 22 and an external shoulder 23.

An impact disc 24 of selected mass is slidable along axis 11 in tube 10 in the direction away from target end 12. Also slidable in tube 10, between the impact disc and the housing, is a firing pin 25 having a conical point 26 for stabbing a detonator in chamber 16, a shoulder 27 for engaging shoulder 22, and a head 30 which is a sliding fit in tube 10. A compression spring 31 is received in a recess 29 in disc 24, and acts between the disc and head 30.

Movement of firing pin 25 towards the detonator is opposed by a crush cup 32 having a flange 33 at one end which engages head 30. The other end 34 of cup 32 is received in shoulder 23 of housing 15. A set of lockout balls 35 are received in bores 20 and are held in place by a resilient retainer band 36 received in a groove 37 in housing 15, the groove being formed with one wall 40 which is tapered. Balls 35 are so sized and positioned that they form diametrical contacts along paraxial lines with shoulder 27 of firing pin 25 and the wall of housing 15 at bores 20, thus preventing any motion of the firing pin toward the detonator by reason of spring 31.

OPERATION

In use, the rainhead is mounted at the front of the fuse of a projectile, with a detonator in chamber 16 for stabbing by point 26 of firing pin 25. Balls 35 are held by retainer band 36 in positions which prevent movement of firing pin 23. Disc 24 is positioned for impact by any target which the missile encounters when fired, including impact by raindrops when any such are present. When the missile is discharged from the firing piece, inertial forces due to acceleration cause movement of disc 24 to compress spring 31, but movement of firing pin 32 is prevented by lockout balls 35. The acceleration forces press the balls between shoulder 22 and housing 15, maintaining the balls in position, but the acceleration forces also act on retaining band 36, which rides up the wall 40 of groove 37 to move rearwardly out of restraining engagement with the balls.

When the missile has left the muzzle of the piece, its axial acceleration ceases, and spring 31 restores disc 24 to its position at end 12 of the rainhead. Pressure of firing pin shoulder 22 on balls 35 also ceases: the missile has taken on a spin about axis 11, and balls 35 are thrown out of bores 20, enabling movement of the firing pin. When the missile impinges a target, disc 24 is forced toward housing 15, acting through spring 31 with sufficient force to crush cup 32 and so enable pin 23 to stab the detonator by point 26, thus firing the detonator and so the load of the missile.

During flight of the missile raindrops may impinge on disc 24. While any one such drop may possess considerable impact force, the force is continued for a time which is quite short compared with the natural period of spring 31 and disc 24 as a mechanical resonant system, and the movement of disc 24 is very small. The frequency of raindrop impact is also so low that disc 24 is returned to its initial position by spring 31 before a second impact occurs. In one embodiment of the invention the mass of disc 24 was 0.006 pounds, and the spring rate of spring 31 was 38.88 pounds per inch.

From the above it will be apparent that a method and apparatus for rendering the fusing of a missile insensitive to raindrops encountered during the missile's flight has been invented, by interposing a mechanical system comprising a spring and a mass, having a natural period which is long compared with the impact time and impact frequency of raindrops.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

The embodiments of the invention in which an exclusive property or rights is claimed are defined as follows:

1. A rainhead for cooperation with the detonator of a ballistic projectile, comprising, in combination:

a tube having an axis extending between apertured target and detonator ends;

an impact disc within said target end of said tube slidable along said axis;

a detonator housing secured within said detonator end of said tube to receive a stab detonator;

a firing pin axially movable in said tube and said housing into a position firing a detonator in said housing;

resilient means transmitting movement of said disc to said firing pin; and lockout means for preventing impact of the firing pin with the detonator during initial firing of the projectile, said lockout means comprising masses engaging said pin and said housing along paraxially lines, apertures in said housing for affording radial egress of said masses from said housing, and band means moveable in response to axial acceleration of said tube between a first position, in which said radial egress of said masses is inhibited, and a second position, in which said radial egress is enabled.

2. Means for rendering insensitive to raindrop impact the fusing of a ballistic projectile by a stab detonator and a firing pin movable by impact to fire said detonator, comprising an impact disc positioned to receive target impacts, and a compression spring between said disc and said firing pin, so that the impact of any raindrop is of short duration compared to the natural period of said disc and said spring.

* * * * *